US006182955B1

(12) United States Patent
Kimble

(10) Patent No.: US 6,182,955 B1
(45) Date of Patent: Feb. 6, 2001

(54) GRID-LOCK VACUUM CLAMPING SYSTEM

(76) Inventor: Alvin Jay Kimble, 13035 SE. Claybourne, Portland, OR (US) 97236

( * ) Notice: Under 35 U.S.C. 154(b), the term of this patent shall be extended for 0 days.

(21) Appl. No.: 09/110,067

(22) Filed: Jul. 3, 1998

(51) Int. Cl.[7] ..... B25B 11/00
(52) U.S. Cl. ..... 269/21; 269/89 R
(58) Field of Search ..... 269/21, 296, 293, 269/289 R; 279/3

(56) References Cited

U.S. PATENT DOCUMENTS 4,723,766 * 2/1988 Beeding ..... 269/21
4,946,149 * 8/1990 Greene ..... 269/21
5,899,445 * 5/1999 Kimble ..... 269/21

* cited by examiner

*Primary Examiner*—David A. Scherbel
*Assistant Examiner*—Benjamin M. Halpern
(74) *Attorney, Agent, or Firm*—Marger Johnson & McCollom, P.C.

(57) ABSTRACT

This invention is a modular vacuum clamping and part manipulation system designed to automate the loading, unloading and vacuum clamping (or holding by means of negative vacuum pressure) of a workpiece during the machining process. The system is designed in such a manner as to allow an end user with limited technical experience to assemble it to meet his/her specific manufacturing requirements and to, at a later date, modify or expand it into a system which has fully automated loading and unloading capabilities.

5 Claims, 9 Drawing Sheets

32
34
35
33
18
11
20

16
17
18
19
20
19
59

7
5
10
13
14
11
12
58
9
6
13
VACUUM CHAMBER
15

GRID-LOCK VACUUM CLAMPING SYSTEM

BACKGROUND OF THE INVENTION

The present invention generally relates to the machining arts and more particularly to a safety and control system for manipulating a workpiece above the surface of a vacuum bed for machining while protecting it from damage during the machining process.

There are three vacuum clamping concepts presently known to the field, all of which rely on a vacuum source and an enclosure (vacuum bed) upon which the clamping device is located. The "vacuum bed", which may or may not be an integral part of the computer numerically controlled (CNC) machining center, creates a negative pressure environment and transfers it, via a series of holes, to its surface. In the following documentation, the term "vacuum bed" is understood to be the above described method of achieving vacuum.

The most common method of achieving vacuum clamping is to use a spoilboard. The spoilboard is secured to the vacuum bed and a series of holes are drilled (within the boundaries of a foam gasket) through it to allow vacuum pressure to be transferred to its surface from the vacuum chamber. Once the workpiece is securely held by vacuum pressure to the spoilboard, the CNC machining center can perform a varied number of operations such as routing, cutting or drilling. As the spoilboard is made of relatively inexpensive materials, any damage to the spoilboard would be negligible compared to the cost of repairing or replacing the vacuum bed itself.

The second method of achieving vacuum clamping is to use flip pods. The Effner flip pod system disclosed in U.S. Pat. No. 5,222,719 is marketed as the Carter flip pod system by the Carter Company.

Each flip pod system includes a spoil board having an array of cavities machined there through. Depending upon the size and shape of the workpiece which is to be machined and the machining process desired, a pod is selectively placed into each cavity in either its "deactivated" position (flush with its host spoilboard) or its "activated" position (elevated and sitting upon its host spoilboard). The pod is designed to sit flush with the surface of its host spoilboard cavity, and to create a seal, thus preventing the transfer of negative atmospheric pressure to the general atmosphere, when it is in its deactivated position. Prior to machining, the machine operator manually turns the pod over in a predetermined configuration to create an elevated clamping surface. Once the workpiece is placed on the activated pods, the vacuum pump is turned on, thereby creating a vacuum clamping action between the pod and the workpiece laid on it. Machining is then commenced in such a manner as to direct the tool path of the machining center through its milling process without coming in contact with the pods themselves. The Effner and Carter flip pod systems have several disadvantages. This process is necessarily time-intensive since each pod must be manually activated or deactivated for machining. Also, these pods require a workpiece that is nearly straight in order to achieve vacuum. If a workpiece is warped, some pods will not make contact with the under surface of the workpiece. This has the undesired effect of either reducing the clamping force because of vacuum leakage or does not draw sufficient vacuum pressure to hold the part at all. Another disadvantage of the flip pod systems is their inability to accommodate many irregular shapes or small work pieces, and because of this they exclude a substantial market share of CNC manufacturing.

The third method of achieving vacuum clamping is the "pop-up" system. An example of such a system is disclosed in U.S. Pat. No. 4,723,766 to Beeding. However, currently known "pop-up" systems such as Beeding are complex and prohibitively expensive compared to other systems.

The pop-up pod systems have the same general components and activation concepts and mechanisms. They are all placed within the vacuum bed or a vacuum container and are "activated" or "deactivated" in principally the same manner. Therefore, the following description should adequately cover all patents in this category.

The Beeding pop-up pod system is composed of a vacuum bed having an array of cavities into which a quantity of pods are placed. Each of the pods are either in one of two states. The pods can be in an effective" state in which they are raised to an elevated position above the surface of the vacuum bed. Alternatively, the pods can be in an "inactive" state in which they are lowered flush with the surface of the vacuum bed. The state of each pod is regulated by commands given through a CNC controller linked to the system.

The intent of the pop-up pod is to create an elevated working surface that transfers negative vacuum pressure from the vacuum bed to the surface of the pod. The workpiece is secured to the elevated pods by vacuum pressure during the machining process allowing the machining tool to penetrate it without damaging the surface of the vacuum bed.

To elevate a selected pod, positive air pressure is directed through a spool valve to an internal pneumatic cylinder which holds the pod against a fixed stop. Once the desired pods are elevated to their active position and the workpiece is placed on them, the machining program commences by turning on the vacuum pump (securing the material blank) and performing the desired machining operation. At the end of a machining operation or a multiple of the same operation (generally termed a "run"), all pods are retracted to their inactive position. Though an advance in the automated machining art, vacuum bed systems constructed according to the Beeding reference include some inherent disadvantages. First, the pop-up systems constructed according to Beeding are too complex and expensive compared to conventional systems to make much of a commercial impact. With the Beeding system, the workpiece is raised only slightly above the working surface which is a highly machined surface with intricate vacuum clamping assemblies set into cavities. If a tool is misprogrammed in the vertical Z-axis, either or both the tool (along with its housing or bearings) and the workpiece is damaged or destroyed. Additionally, the Beeding pop-up system is not flexible enough to perform a variety of machine table functions such as load/unloading, clamping and the like which facilitates the machining process. Finally, Beeding by design is not capable of accommodating irregular shapes common to CNC manufacturing. For example, the Beeding pods are positionable in either a fully raised position or a fully lowered position. If the workpiece has an irregular surface, the vacuum clamping of the pods on the surface of the workpiece would be seriously impaired due to vacuum leakage.

Accordingly, the need arises for a vacuum bed system which provides a flexible, modular design in an automated bed which overcomes the complexity and expense of the prior art.

PATENTS RESEARCHED ARE 5,372,357—Blaimschein
5,364,083—Ross et al.

5,249,785—Nelson et al.
5,222,719—Effner
5,203,547—Marumo
5,120,033—Shoda
5,110,239—Riley et al.
4,946,149—Greene
4,723,766—Beeding
4,721,462—Collins, Jr.
4,684,113—Douglas et al.
4,088,312—Frosch et al.

SUMMARY OF THE INVENTION

It is an object of the invention to provide a vacuum clamping system which is modular in design and constructed or assembled in such a manner as to allow any part to be removed or replaced easily. This modular concept allows for sections (planks) of the vacuum bed to be replaced in the event of damage or as there is a need to replace it with a plank containing custom accessories such as load/unload conveyors.

It is further the objective of the invention to limit damage to the CNC equipment by providing both software and mechanical-electrical equipment safety checks.

It is also the objective of the invention to provide a means whereby the CNC machining system can be quickly restarted after there is damage to the vacuum bed by replacing the damaged section (plank(s)) quickly. These sections, by their design, can be easily repaired off-line and replaced without causing equipment down time.

It is also the objective of the invention to provide a simple method of placing any number of vacuum chucking devices or accessories into the array of cavities in any desired combination.

It is an objective of the invention to design the vacuum chucking devices or, accessories in such a manner as to eliminate the need for either vacuum or pressurized plumbing for the operation of those devices.

It is an objective of the invention to supply to the customer a vacuum clamping system that is evolutionary in design. This is to say that the end user can purchase a basic mounting board and planks that is manually controlled and, at any time, add or design any accessory that may be required for a specific job application. He/she can, at any time in the future, upgrade the system to a fully automated programmable system that can be operated simultaneously and in conjunction with the program running the CNC equipment.

In summary, it is the objective of the invention to create a vacuum clamping system that is modular, inexpensive, easily customizable on a per job need basis, disposable without the use of extensive wiring, plumbing or complicated assembly restrictions.

The invention is a vacuum clamping system which comprises an apparatus for supporting a vacuum chucking (clamping) a workpiece. The system includes a mounting board that contains an array of electrical contact-clusters distributed in an even array across its surface. These electrical clusters transmit electrical current or signals to and from the system control circuitry.

Attached to the mounting board is a multiple of planks with cavities evenly spaced across its length in such a manner as to align the cavity over the electrical cluster. The plank is securely attached to the mounting board and the cavities are covered with a cap so as to create a vacuum tight bed. The planks are easily removable in the event of damage or when they need to be removed for (temporary) replacement by the material conveyance planks.

With the system is offered a large array of accessories that can be placed into any of the cavities. Many of these accessories are listed in the detailed description. Accessories are designed to meet the equipment requirements for most job applications but can be custom designed for specific application. The common link between all accessories is that they are mounted into any desired address and that they are actuated by an electrical signal. The system can be upgraded to hold feed back accessories that sense a workpiece or signal that a specific command is being or has been performed. Each upgrade would require additional electrical circuitry in the mounting board. Therefore, it seems feasable to keep the system as simple as possible except for custom applications.

A simple example of how the system would work is described in the following paragraphs. Company X is a woodworking plant which has a CNC router and which receives an order for a particular furniture part. The programmer draws out the part in a CAD/CAM program. The CAD/CAM software prepares the machine code to both operate the machining center and the vacuum chucking table mounted thereon. The software is sent to the machining center as well as a copy of a set-up sheet is given to the machine operator.

The machine operator removes the appropriate address cover caps and places whatever accessory is assigned in that cavity. Once the set-up phase is completed the operator presses the 'Start' button on the machining center and a sheet of raw material is loaded onto the vacuum bed via the pop-up belt conveyor. When the raw material reaches some pop-up stops, the pop-up conveyor and stops lower, setting the raw material directly on the elevated vacuum chucking cups. The program turns on the vacuum chucking cups and the raw material is securely held into position. The machining operation commences and the router produces the desired part. When completed the workpiece and scrap can either be manually or automatically removed and the cycle starts over again. This process is more fully described and illustrated in the detailed description.

BRIEF DESCRIPTION OF DRAWINGS

FIG. 24 is a pop-up pin. Its purpose is to supply a low friction surface on which to slide a workpiece during loading.

DETAILED DESCRIPTION

The Grid-Lock system is designed to be modular, with the ability to build from a basic table top into a fully automatic system. For this reason each aspect will be described as a separate entity. There are several terms that will be used throughout the description, they and are defined in the following statements.

Address: An address is defined as one segment of a plank assembly. It is square in shape, containing a large center cavity surrounded by four smaller cavities. Each address is isolated by a rubber gasket so that vacuum pressure is contained within the boundary of the containment gasket. In the bottom of each large cavity is a double electrically conductive ring through which electric current passes to any of the electrically charged accessories placed within the cavity.

Plank: A plank is a solid body of plastic resin into which is molded on precise increments the cavities that make up an address (see FIG. 5) Planks are made to a length that corresponds with the surface of the vacuum bed it is to cover. Each plank has an electrical connection at one end that plugs into a control strip that carries electrical current and signals to the individual addresses.

Figures 1, 2:
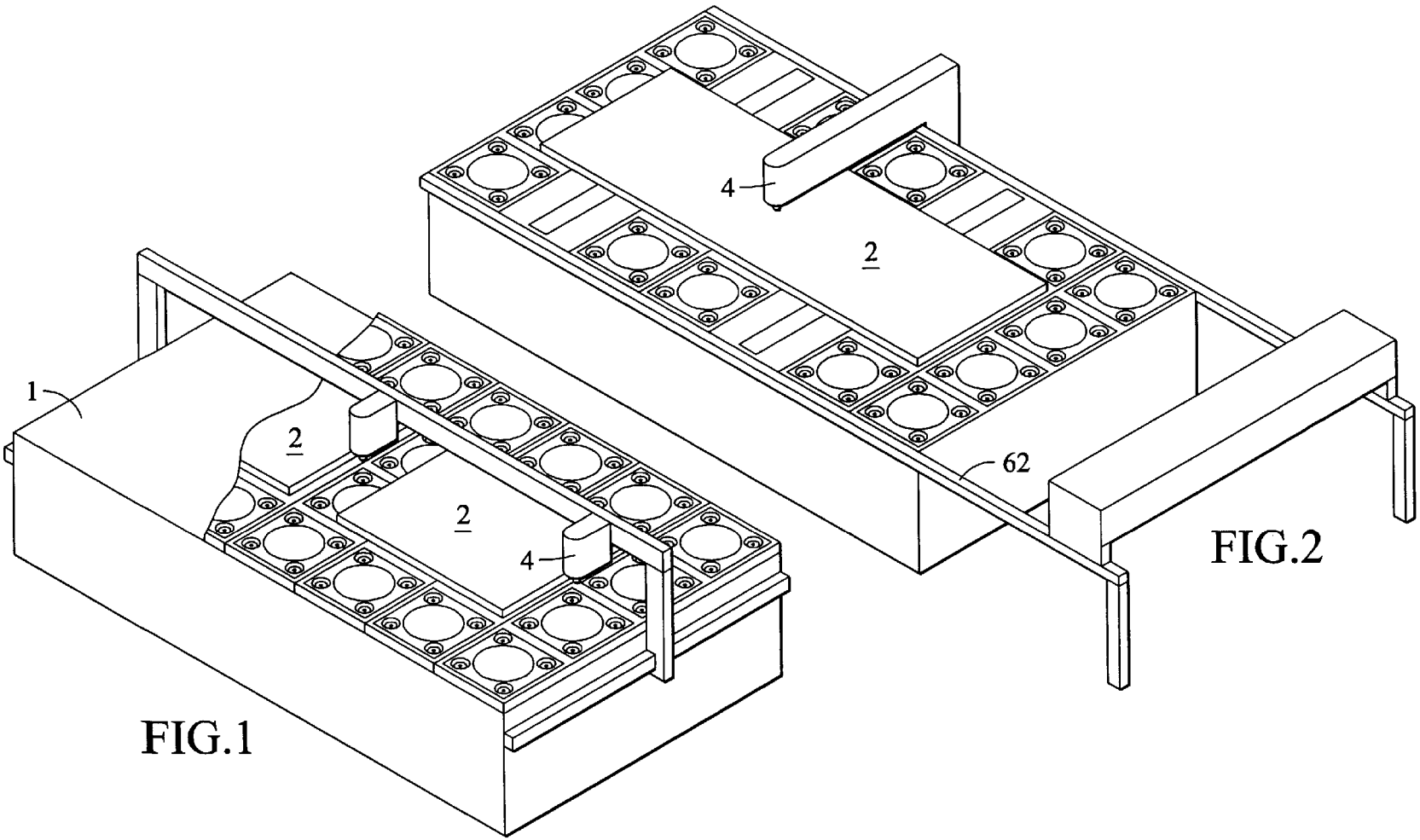
FIG. 1 is a representation of a CNC bed in which the bed moves front to back. With these systems the machining tool is carried by a (gantry) beam and moves horizontally and/or vertically. Shown is the surface of the machine covered with a quantity of the Grid-Lock vacuum clamping planks which form a solid array of vacuum clamping addresses. The cut away section represents the actual machine table top.
FIG. 2 is a representation of a system in which the bed is fixed and the machining head is moveable in all three directions (X, Y, Z axis). It shows two Grid-Lock planks removed and replaced by two drop-in pop-up conveyor assemblies (see FIG. 6).

FIG. 1 shows a perspective view of an exemplary vacuum machining table with a quantity of Grid-Lock planks (FIG.

5) placed side by side covering the surface of the vacuum bed 1. A spoilboard or workpiece 2 is accurately placed onto the vacuum bed and is held in place by vacuum chucking force. A tool assembly 4 (which can be any number of machining tools) is moveable to any position over the vacuum bed for the purpose of machining the workpiece. It should be noted that the art of part machining is so understood throughout the industry that little description of the concept itself is necessary.

Turning to the aspects of the invention, a control buse (FIG. 7) is placed across one edge of the CNC machining table. It contains two levels of vacuum bed control plates. The manual or upper plate 47 contains one activation switch 36 for each address in the plank it controls, one jump switch 37, and one section-power switch 38. The operation of the manual switch assemblies are as follows: when an operator desires to operate the vacuum bed manually, he/she will enable desired addresses in a selected plank by turning on the switch 36 that corresponds with that address. If a grouping of addresses needs to be simultaneously enabled that involves more than one plank, the operator turns on all the affected switches 36 and the jump switch 37 that will make an electrical connection between the control card segments that affect the planks involved in the grouping of addresses. This action creates a continuous connection between all addresses in the grouping regardless of the specific plank on which they reside. To enable the grouping of addresses the operator has only to press one of the power switches 38. This power switch 38, opens current to all the switches of the selected group and consequently their respective addresses. To disable the group, the operator simply presses the power switch 38 again. This manual wiring concept allows numerous groupings of addresses to be enabled or disabled without affecting the other address groups.

The lower card 39 is the automatic control card of the system. It is also divided into sections, with each section controlling the addresses of the plank plugged into it at the edge card connector 46. For the automatic system to work correctly, a sequence of events will naturally be followed. The description of these events will be discussed in order to help the reader to better understand the logic sequence. Please refer to FIG. 32 for an abbreviated illustration of the event sequences.

Figure 32:
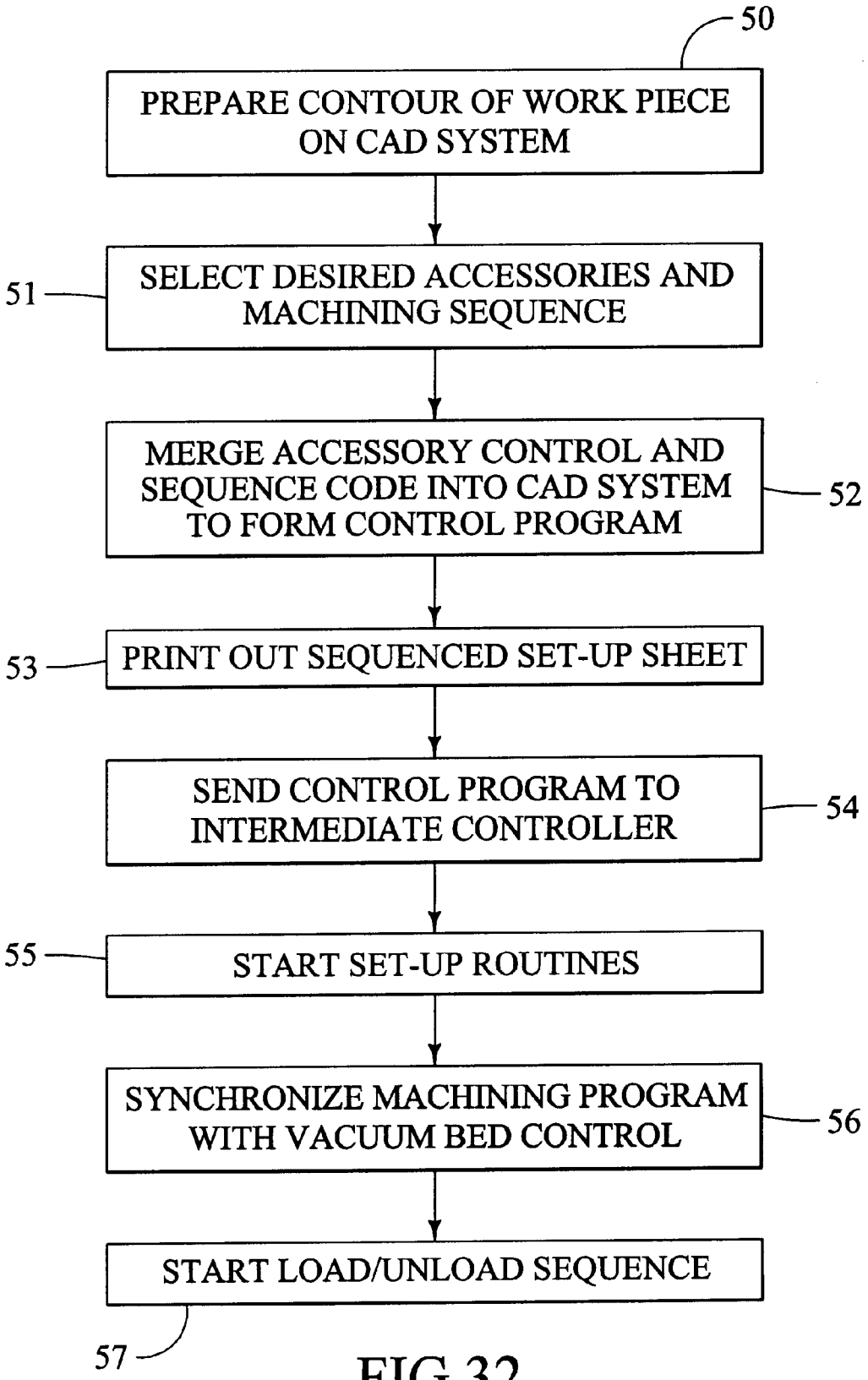
FIG. 32 is a flow diagram illustrating the operation of the invention.

Prepare Contour of Workpiece on CAD System (FIG. 32 #50).

The programmer first receives an order to machine a specific pattern out of a workpiece. That pattern is drawn in a CAD program and then a machine code is generated from the contour drawn into the personal computer (PC). Because the desired contour is drawn over a representation of the vacuum bed, the operator is able to determine which addresses of the vacuum bed will be affected.

Select Desired Accessories and Machining Sequence 51.

At the same time the machine code is developed, an additional set of vacuum table code is developed that operates the affected grouping of addresses.

Merge Accessory Control and Sequence Code into CAD/CAM System to Form Control Program 52.

The combining of the machine code and vacuum bed code in the sequence desired, enables the CNC machining center and the vacuum bed controller (FIG. 8) to operate in a coordinated manner that allows groups of addresses to be enabled or disabled in a manner that facilitates for the most efficient usage of the combined equipment. By the proper preparation of machining sequences, vacuum bed group sequences, and related parafinilia such as load/unload (L/U) units or accessories, a fully automated system can be developed.

Prints Out the Sequenced Set-Up Sheet 53

Once the program has been developed the programmer prepares any pertinent operating instructions. This information tells the machine operator how to prepare the CNC machining center as well as the vacuum bed. It also helps the operator to know in advance just how the individual operational sequences will occur. By following the printed information, the operator can achieve the fastest set-up rates as well as test for programming errors before starting the production run.

Send Control Program to the Intermediate Controller 54

The intermediate controller strips out the vacuum bed control code and sends the remaining code on to the machining center.

Synchronize Machining Program with the Vacuum Bed Control 56.

Once the program has been installed, the vacuum bed controller (FIG. 8) and the machining center controller synchronize the operations of the two systems.

The Load/Unload Sequence 57

For systems with a L/U system, the operation would naturally be included in the complete program package.

Figure 10:
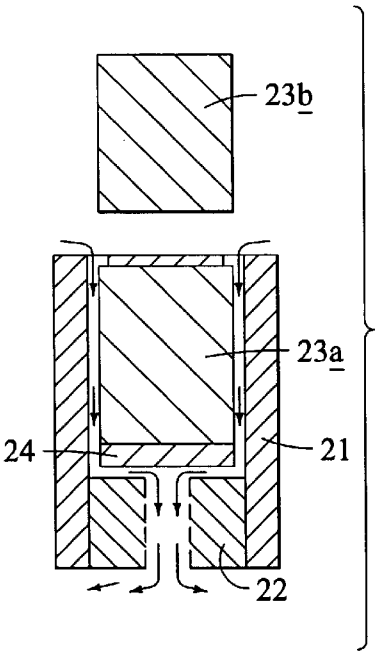
FIG. 10 is a magnetic vacuum locking valve. It is activated mechanically by a magnet placed in an accessory or spoilboard. In brief, when an accessory is placed onto an address, the magnet of that accessory attracts the magnet or metallic slug in the valve cavity drawing it vertically, unstopping a vacuum port in its base. Vacuum pressure creates a locking action between the accessory and the vacuum bed. If an elevator block or spoilboard (with the attractant magnet) is placed over the vacuum address, the result is that the block is locked in place while vacuum to its surface is controlled independently via the solenoid in the vacuum cell set into the plank cavity.
Figure 11:
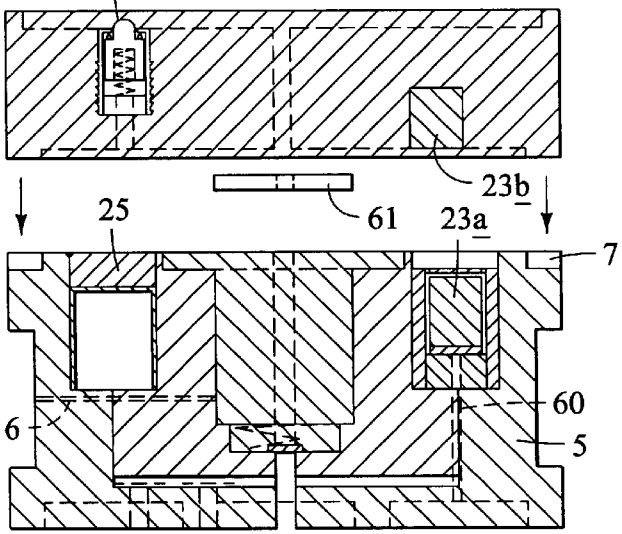
FIG. 11 shows an end view of a plank with a vacuum cell placed into the plank cavity. It also shows one magnetic vacuum locking valve in a plank cavity and a dummy filler in another.
Figures 13, 15, 23, 25:
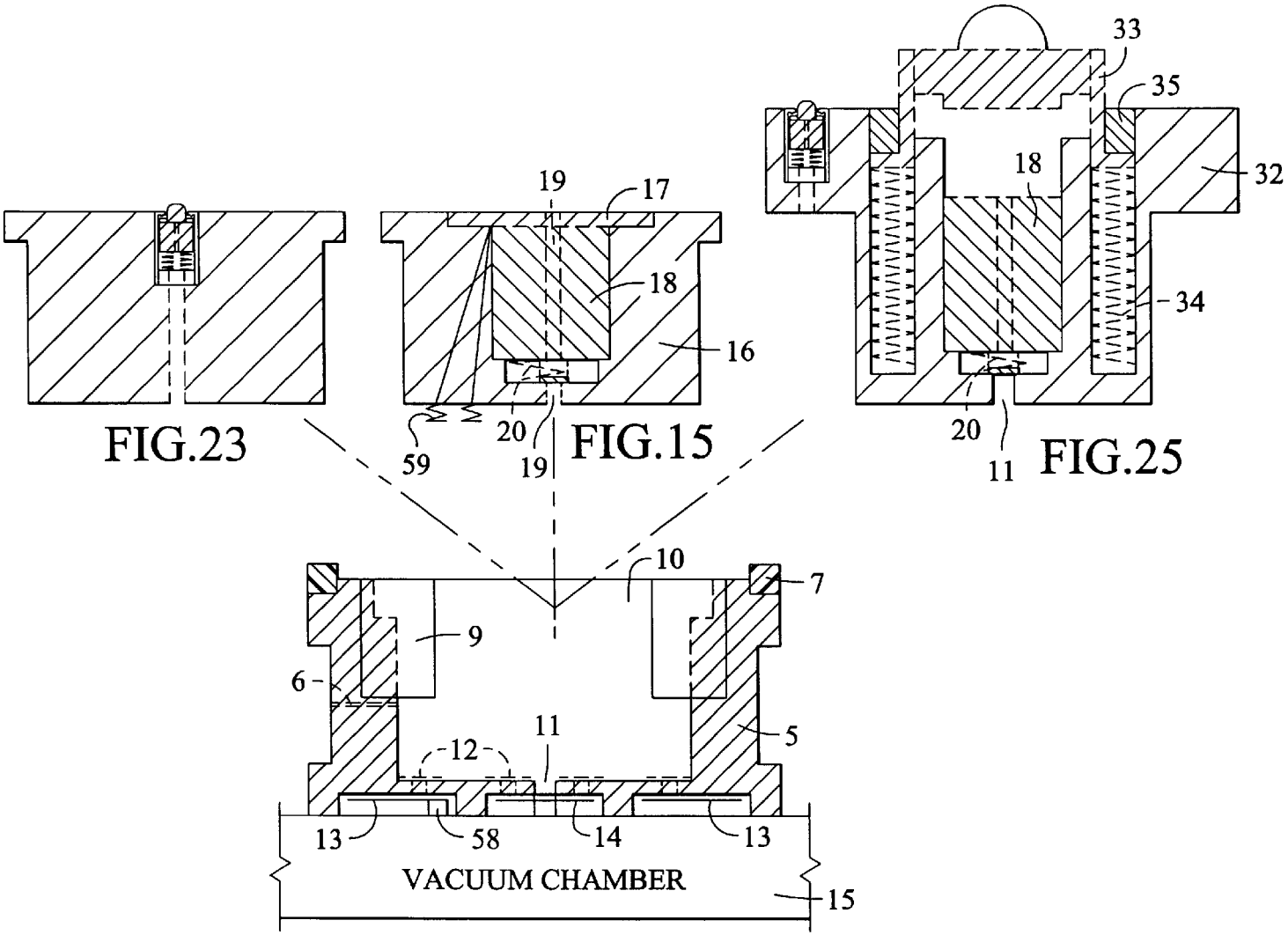
FIG. 13 shows an end view of a plank with the center and plug cavities empty.
FIG. 15 is a vacuum cell. It is placed in any cavity where the program calls for controlled vacuum to the bed surface. The solenoid within the cell body is selectively enabled to allow vacuum pressure from the vacuum chamber (FIG. 12) to the specific grid address in which it is placed.
FIG. 23 is an address plug. Every address is supplied with one plug. It is designed so that it is held in the plank cavity by vacuum and is removed by pressing the vacuum relief button.
FIG. 25 is a pop-up bearing or roller. The pop-up bearing allows a workpiece to be rolled into position from any direction. The pop-up roller allows movement on or off the table in only a linear direction.

FIG. 13 shows a cross-sectioned end view of a plank setting on a vacuum chamber while FIG. 11 shows a cross-sectioned end view of a plank with a vacuum cell (FIG. 15), magnetic vacuum valve (FIG. 10). The aspects of the invention as they relate to an individual address are as follows. The plank 5 is composed of either solid resin or hi-density foam molded in a continuous running body that is punctuated with a redundant series of cavities. Each group of cavities contain one large center cavity surrounded by four smaller cavities 9. Each address is isolated by a gasket barrier 7 that retains vacuum pressure within its parameters.

Figures 5, 6, 7, 8:
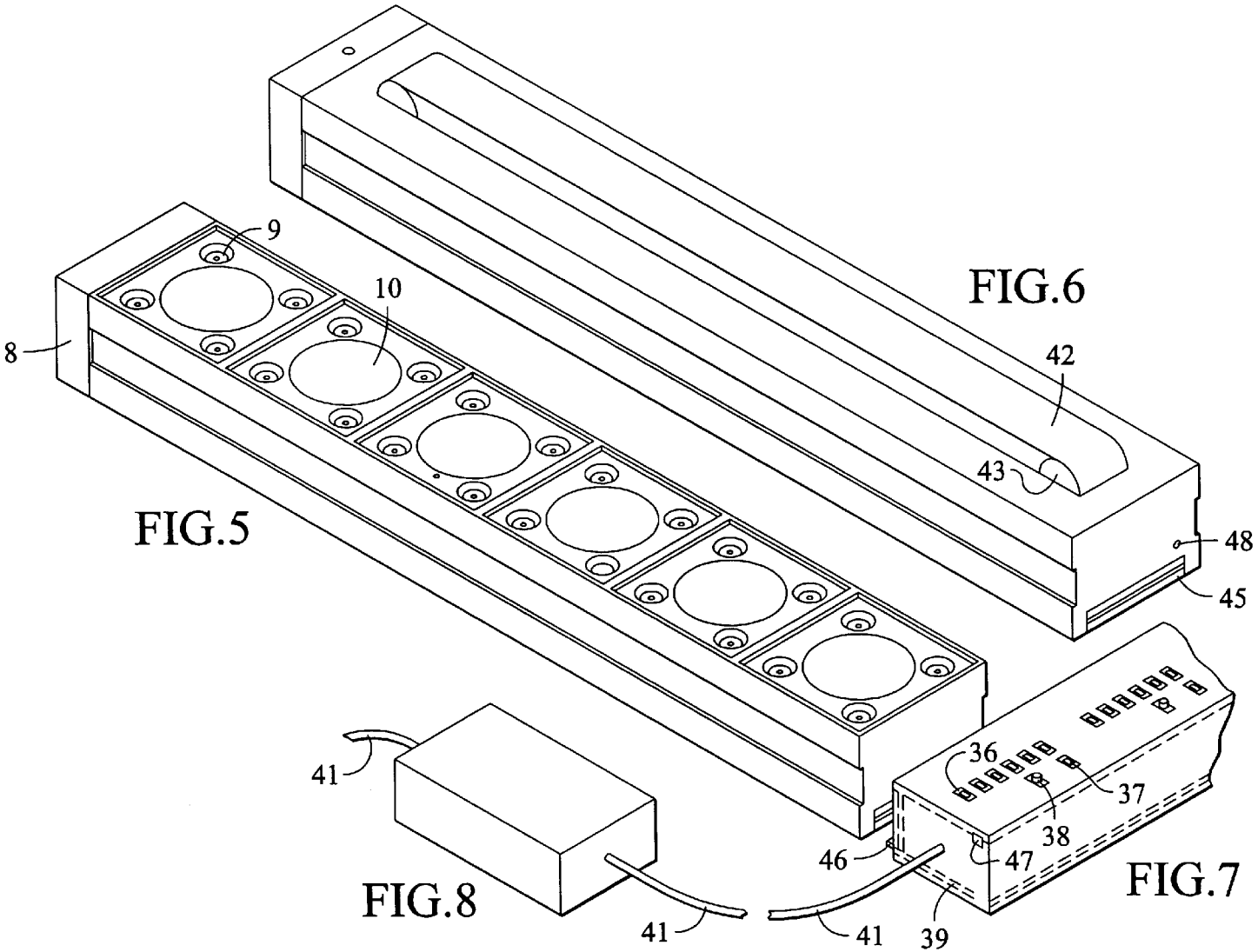
FIG. 5 is an actual plank assembly. The plank is capped (#8) and connects to a control buse (FIG. 7) via an edge card connector.
FIG. 6 is a pop-up belt conveyor that can replace any plank assembly to assist in the loading or unloading of a workpiece.
FIG. 7 is a control buse. It houses a double stack logic card that transmits operation commands from the controller to each address on the plank. The upper stack is supplied with manual switches and the lower contains the automated logic chips.
FIG. 8 is a controller box that holds the vacuum bed operations program. It houses a small PC controller and program. The programs recorded in it work in conjunction with the programs in the machining center to enable or disable specific groupings of addresses in a sequence consistent with the machining requirements of the CNC router or point-to-point.
Figure 33:
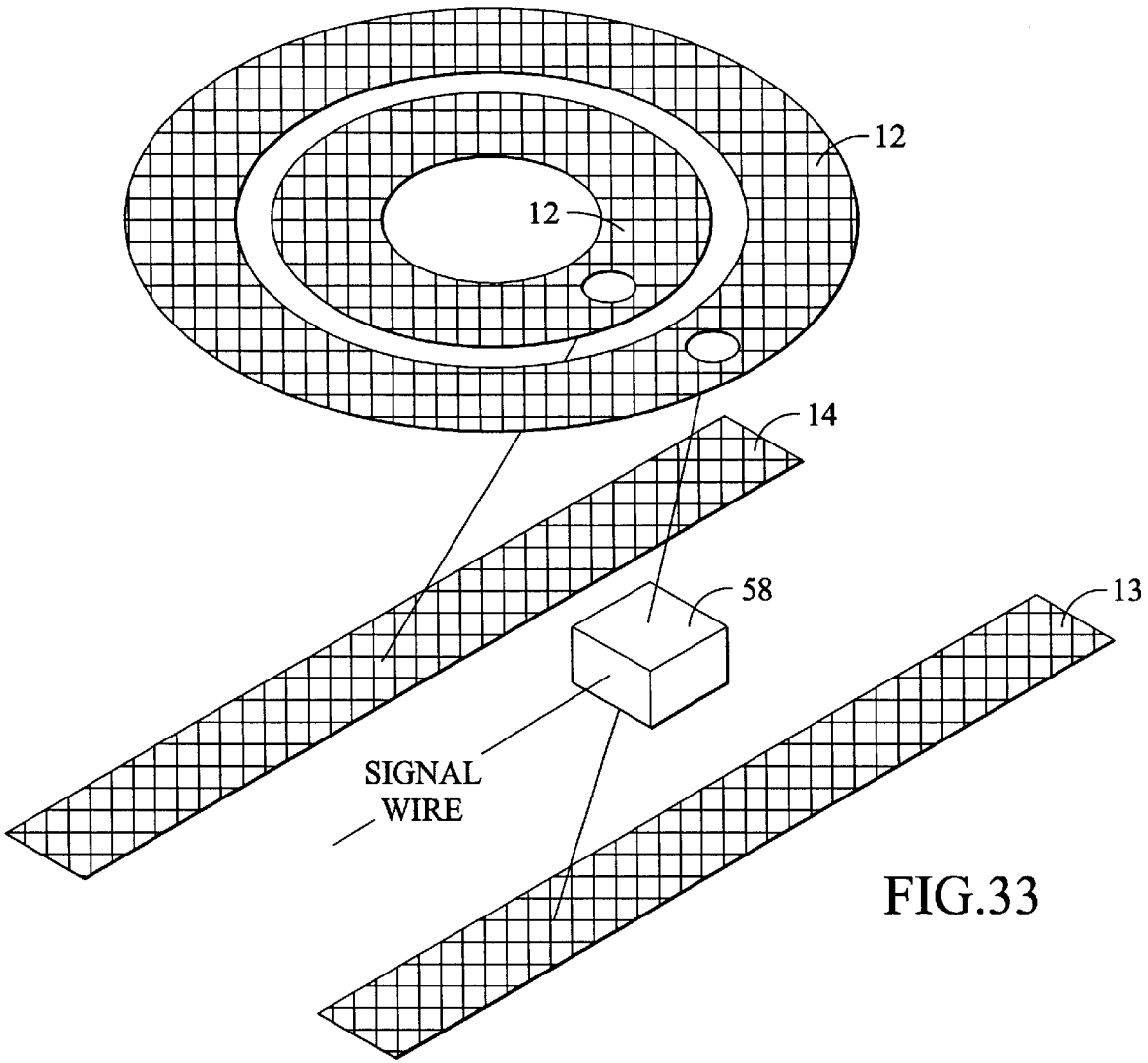
FIG. 33 is a schematic view showing the preferred arrangement of electrical contacts for each accessory cavity coupled to the control strip of FIG. 7.

The center cavity 10 is designed to receive accessories (FIG. 14 through FIG. 26). In the bottom of each large cavity is a hole 11 through which vacuum is transmitted. Encircling it are two metal rings 12. The smaller or inner ring contains an impression and receives a small screw that acts as an electrical conductor between it and a continuous metal strip 14 attached to the bottom center groove of the plank body. Acting as a conductor between the larger ring and the grounding strip 13 is a small transistor which opens or closes the electrical circuit depending on the signal sent from the control strip (FIG. 7) via a small wire. Any electrical enabled solenoid placed in the large cavity 10 has two conductive springs 59 that carry current to and from the solenoid 18 thereby completing the closed circuit between the two rings 12. In short, positive electrical current travels from the metal strip 14 through a screw to the small conductive ring 12. The current is then carried through the spring resting on the small ring through the solenoid and to the larger ring via the second spring resting on it. To close the circuit, power passes from the large ring through the transistor 58 on to the ground strip 13. The transistor acts as power control gate, enabling or disabling the solenoid depending on the signal it receives from the control duct (FIG. 7). For a graphical illustration of this see FIG. 33.

Figures 6A, 14, 15A, 16, 17, 18, 19, 20, 21, 22, 23A, 24A, 25A, 26, 27, 28, 29:
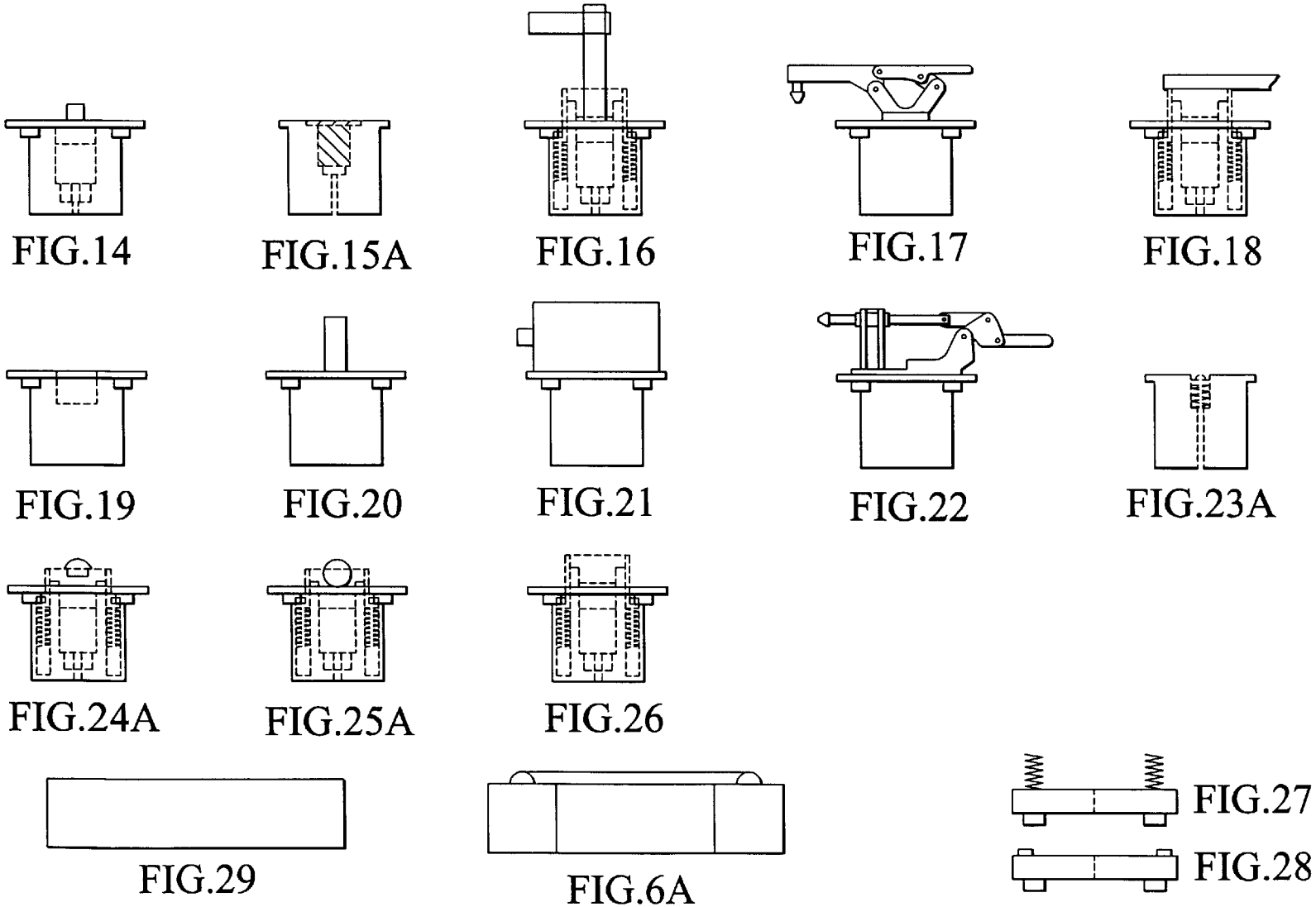
FIG. 14 shows a pin clamp (accessory). Its purpose is to hold a small workpiece above the vacuum bed surface. It is most often used on large moldings or custom handrails.
FIG. 16 is a vertical stack clamp. Its purpose is to hold multiple layers of workpieces during a machining or interior routing sequence.
FIG. 17 is a vertical manual clamp. It simply holds a workpiece in place during the machining operation.
FIG. 18 is a frame clamp. Its specific clamping jaw design enables the holding of a door frame for edge machining.
FIG. 19 is a position sensor.
FIG. 20 is a fixed stop.
FIG. 21 is a horizontal clamping or positioning cylinder.
FIG. 22 is a manual horizontal clamping or positioning clamp.
FIG. 26 is a pop-up stop.
FIG. 27 is a elevator block with a diaphragm suction cup. It is designed to be used where the workpiece is likely warped or has an uneven contour.
FIG. 28 is a standard elevator block. It is square or rectangular. Its purpose is to hole the workpiece via vacuum pressure above the machining bed there-by allowing the machining tool to penetrate the workpiece without coming in contact with the vacuum bed.
FIG. 29 is a representation of a drop-in plank with an air-bed surface. This same technology can be used with a single or group of elevator blocks. The purpose is to float the workpiece into position on a pillow of pressurized air. These will be used on plank assemblies that are supplied with positive air pressure as an added feature to the normal vacuum source.
Figure 12:
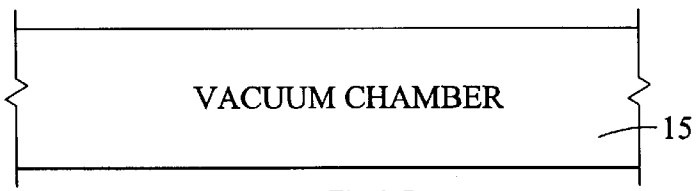
FIG. 12 shows a representation of a vacuum chamber. Every machining center must be supplied with some form of vacuum source and chamber.

The magnetic vacuum locking valve (MVL) (FIG. 10) is placed in one of the four parameter holes 9 surrounding the center cavity of each address. A small connecting duct 60 is drilled from the bottom of the cavity 9 to the base of the plank body. This duct supplies vacuum to the bottom of the MVL. The valve works as follows. Contained inside the valve housing assembly 21 & 22 is a magnet or metal slug 23*a* with a rubber stopper attached to the bottom. The magnet with his stopper rests on the housing assembly plug 22, blocking atmospheric air from being drawn into the vacuum chamber. When any accessory with a magnet 23*b* is placed over the MVL, the attraction of the upper magnet 23*b* pulls the magnet 23*a* off its seat 22 thereby allowing atmospheric air to be drawn into the vacuum chamber. The resulting effect is that the atmospheric air contained between the accessory and the gasket seal 7 surrounding the address being covered is exhausted creating a vacuum lock between the accessory and the plank address. If an elevator block FIG. 28 is placed over the address, a circular gasket 61 creates a seal between the vent hole of the block and the top of the vacuum cell (FIG. 15) contained in the cavity. This seal allows the block to be mechanically locked to the address via vacuum pressure while still allowing controlled vacuum pressure to be transmitted to its surface from the vacuum chamber (FIG. 12) via the vacuum cell (FIG. 15).

Figure 9:
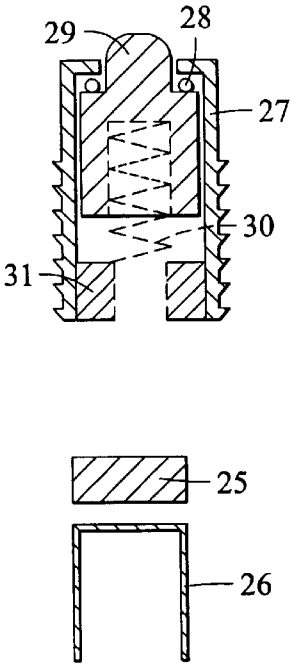
FIG. 9 is a relief placed in any accessory for the purpose of breaking the vacuum lock of that piece to the vacuum bed. It can also be placed into the vacuum bed to create a vacuum lock between a spoil board or elevator block.

In all accessories there can be placed a relief valve (FIG. 9). The purpose of the relief valve is to momentarily allow atmospheric air to break the vacuum lock created by the MLV. This is done by depressing the valve button 29 thereby allowing air to flow through the valve into the space between the accessory and the plank address. The loss of vacuum pressure allows the accessory to be easily removed. The removal of the accessory breaks the attraction the two aligned magnets 23 *a*&*b*, causing magnet 23*a* to again block the plug seat 22 of the MVL assembly.

A drawing of any typical pop-up accessory is shown in FIG. 25. The principal parts are the housing 32, plunger 33, spring 34, retaining ring 35, and solenoid 18. Attached to the plunger can be any of several accessory components such as, roll or bearing FIG. 25, pin FIG. 24, stop FIG. 26, vertical clamp FIG. 16 or frame clamp FIG. 18. All of the preceding accessories are electrically accepted in the same manner as described in preceding paragraphs. The general principal of accusation is as follows: the spring(s) 34 apply upward force against the plunger 33. This force holds the plunger against the retaining ring 35. In order for the plunger to be drawn, down the solenoid 18 must be energized. This causes the stem 20 of the solenoid to be retracted opening the vacuum port. Vacuum then passes around the solenoid body creating a negative pressure condition in the cavity between the solenoid and the plunger. This negative condition causes the spring(s) to collapse thereby drawing the plunger downward to its seat. It will remain retracted until the solenoid is deenergized and atmospheric pressure is again allowed to reenter the cavity below the plunger.

The pop-up belt conveyor is simply a small belt conveyor that is housed in a tubular body the same size as the plank assemblies. The belt is driven by an air motor and elevated by air cylinders. The air source may be a special air duct 49 contained in the control strip and transferred to the conveyor assembly via an air port 48, or it may be an external hook up. The accusation of the drive and pop-up cylinders is done through the edge card connector 46 and receptacle 48.

Figure 3:
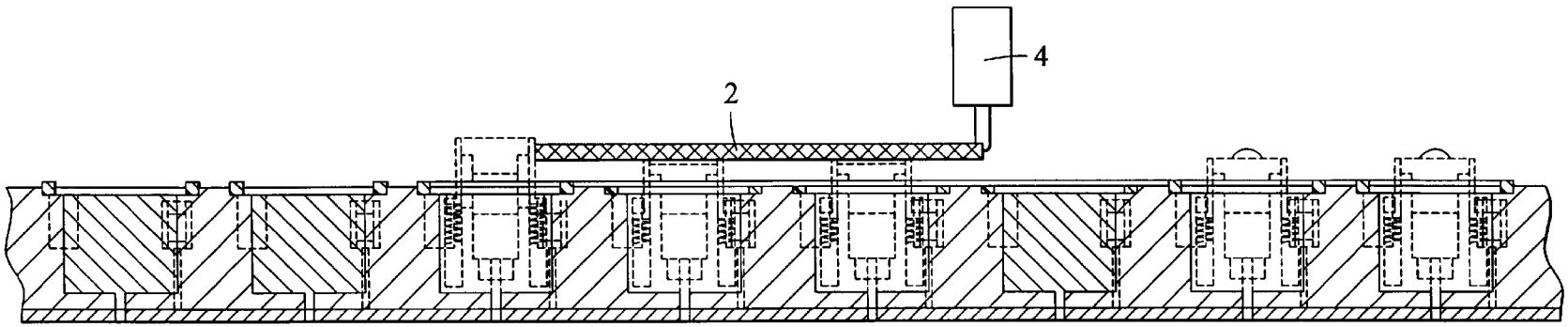
FIG. 3 is a side sketch of a plank assembly holding a workpiece for machining with two pop-up bearings (FIG. 25), two pop-up vacuum cups, one pop-up stop.
Figure 4:
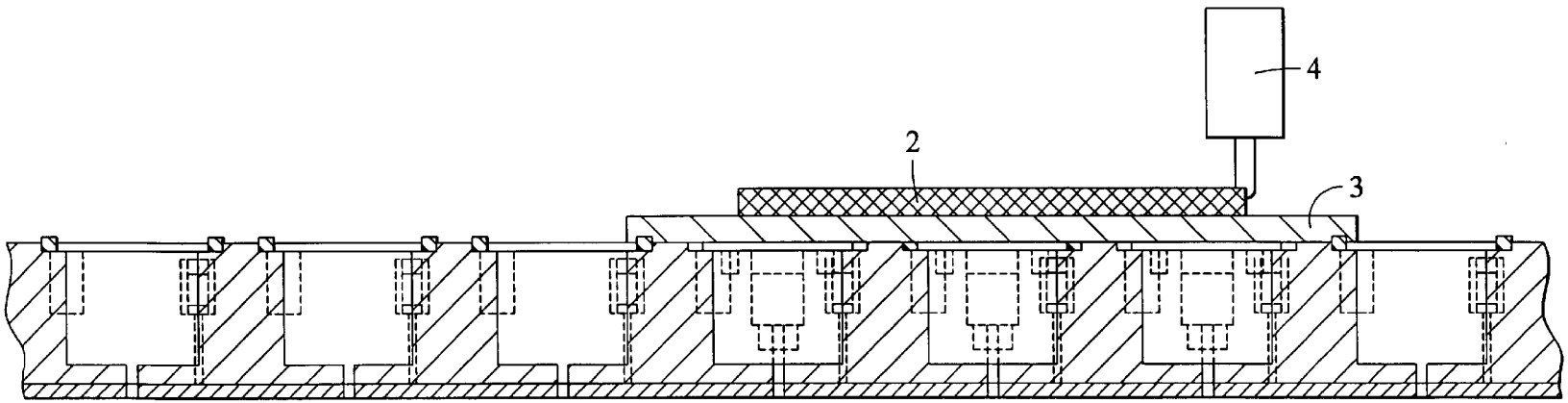
FIG. 4 is a sketch of a plank assembly with a slip-sheet and the workpiece being held in place by vacuum.

The table vacuum 63 (TV) FIG. 3 is simply a vacuum plenum that can be lowered by cylinders for the purpose of removing fine debris from the table top. It can be placed into a metal housing by itself or in conjunction with the L/U vacuum cups.

The L/U vacuum cups (VC) are designed to be placed within a housing 68 with a vacuum source 65. They can be configured as the customer desires, but the general concept is to place them in a pattern that matches the grid of the vacuum bed. The vacuum cups are drawn for illustration only. Each VC contains a solenoid valve inside a vacuum housing 64, a bell 68, bellows 66 and touch pin 67. The operational concept is as follows. When the L/U assembly is positioned over the vacuum bed, the legs which are attached to pneumatic cylinders lowers the housing assembly 69 so that the touch pins 67 rest securely on the workpiece. In the event the workpiece is elevated, the bellows touching the workpiece depress, allowing other bellows not positioned over the workpiece to extend down further to the fallen scrap. The combination of program logic (turning on only the VC units that touch the workpiece or known scrap) and the touch pins allows for only vacuum to pick up the desired parts and scrap. When a vacuum seal is made between the VC unit and its intended target, the vacuum pressure causes the diaphragms to contract pulling the workpiece and debris to the most elevated position. Once this is accomplished, the housing is also raised and moved to the ends of the rails 62. The programmer can create a program in such a manner as to drop the debris at one location while the finished workpiece is positioned at its desired destination.

I claim:

1. An apparatus for supporting and chucking a workpiece comprising:

a control bus;

a plurality of planks in electrical contact with the control bus, each of said planks having an upper surface onto which a workpiece can be positioned;

a vacuum source coupled to the planks;

a linear array of addresses on each of the planks coupled to the vacuum source, each of said addresses responsive to signals transmitted from the control bus.

2. The apparatus of claim 1 wherein each of the addresses includes a cavity into which any one of a plurality of accessories can be placed for supporting and holding via vacuum force, conveying, sensing or positioning the workpiece.

3. The apparatus of claim 1, further including:

an accessory coupled at a selected address of one of the planks for supporting and holding via vacuum force, conveying, sensing or positioning the workpiece on the upper surface; and return signal means for transmitting a diagnostic signal from the accessory to the control bus.

4. The apparatus of claim 1, further including:

a plurality of manual switches, each of said addresses being activated responsive to a respective one of the switches; and a group switch associated with a subset of the plurality of addresses, said subset of addresses being simultaneously activated responsive to the group switch.

5. The apparatus of claim 1, further including a pod in each of the addresses, said pod having a raised position and a lowered position relative to said upper surface of said planks responsive to signals received from said control bus.

* * * * *

UNITED STATES PATENT AND TRADEMARK OFFICE

CERTIFICATE OF CORRECTION

PATENT NO. : 6,182,955 B1
DATED : February 6, 2001
INVENTOR(S) : Kimble

It is certified that error appears in the above-identified patent and that said Letters Patent is hereby corrected as shown below:

Column 2,
Line 65, "PATENTS RESEARCHED ARE" should read -- PATENTS RESEARCHED ARE: --

Figure 30:
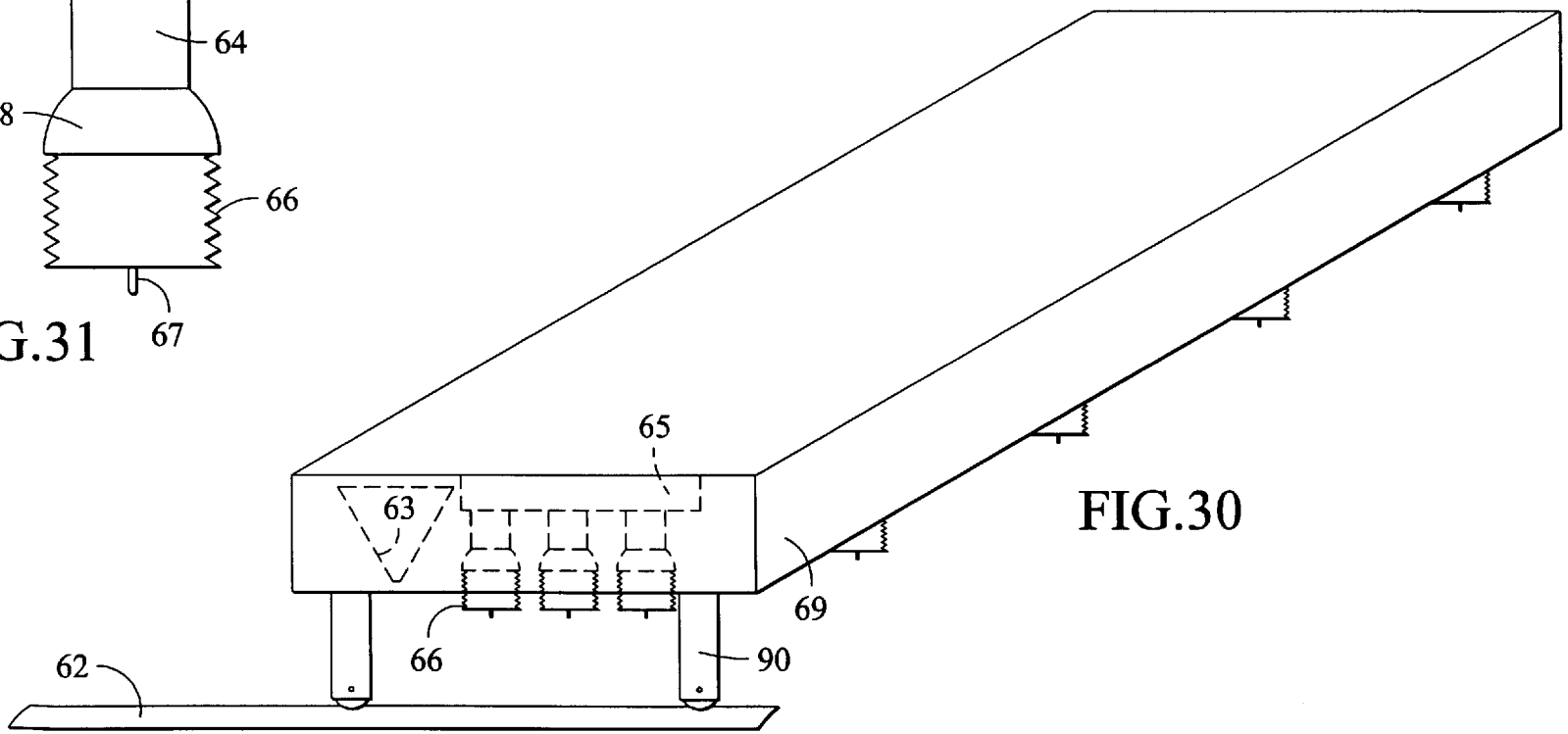
FIG. 30 is an accessory removal handle. It is supplied with a magnet in its base so that the machine operator can easily remove any of the flush mounted accessories.
Figure 31:
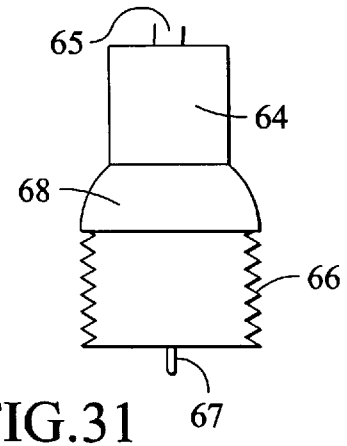
FIG. 31 is a representation of the 'table vacuum' (TV unit) or 'load/unload' (L/U unit) assembly. Generally these two features are housed in the same jacket. The TV unit is simply a vacuum plenum that rides over the vacuum bed after a workpiece and debris has been removed. Its purpose is to remove any dust and small debris by vacuum. The L/U unit uses programable suction cups to pick up the finished workpiece and debris and remove them automatically from the vacuum bed. Once the workpiece and debris is removed, the debris is deposited at one spot and the workpiece another.

Column 3,
Line 36, "devices or, accessories" should read -- devices or accessories --;

Column 8,
Line 66, "magnet with his stopper" should read -- magnet with it's stopper --;

Column 9,
Line 54, "FIG 3" should read -- FIG 30 --.

Signed and Sealed this

Twentieth Day of January, 2004

JON W. DUDAS
*Acting Director of the United States Patent and Trademark Office*